US009360202B2

(12) United States Patent
Maxik et al.

(10) Patent No.: US 9,360,202 B2
(45) Date of Patent: Jun. 7, 2016

(54) SYSTEM FOR ACTIVELY COOLING AN LED FILAMENT AND ASSOCIATED METHODS

(71) Applicant: LIGHTING SCIENCE GROUP CORPORATION, Melbourne, FL (US)

(72) Inventors: Fredric S Maxik, Cocoa Beach, FL (US); David E Bartine, Cocoa, FL (US); Robert R Soler, Cocoa Beach, FL (US); Ran Zhou, Rockledge, FL (US); Addy S Widjaja, Palm Bay, FL (US); Valerie A Bastien, Melbourne, FL (US); Mark Andrew Oostdyk, Cape Canaveral, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 0 days.

(21) Appl. No.: 14/591,521

(22) Filed: Jan. 7, 2015

(65) Prior Publication Data

US 2015/0159853 A1 Jun. 11, 2015

Related U.S. Application Data

(60) Continuation-in-part of application No. 14/084,118, filed on Nov. 19, 2013, now Pat. No. 9,151,482, which is a continuation of application No. 13/461,333, filed on May 1, 2012, now Pat. No. 8,608,348, which is a (Continued)

(51) Int. Cl.
*F21V 29/00* (2015.01)
*F21V 29/58* (2015.01)
(Continued)

(52) U.S. Cl.
CPC ..... *F21V 29/59* (2015.01); *F21K 9/135* (2013.01); *F21K 9/1355* (2013.01);

(Continued)

(58) Field of Classification Search
CPC ..... F21V 29/59; F21V 29/503; F21V 29/65; F21V 29/78; F21V 29/02; F21V 23/009
See application file for complete search history.

(56) References Cited

U.S. PATENT DOCUMENTS 5,057,908 A 10/1991 Weber
5,523,878 A 6/1996 Wallace et al.

(Continued)

FOREIGN PATENT DOCUMENTS

EP 1950491 7/2008
EP 2707654 3/2014

(Continued)

OTHER PUBLICATIONS

STIC Search Results. Feb. 12, 2016.*

(Continued)

*Primary Examiner* — Evan Dzierzynski
*Assistant Examiner* — Christopher E Dunay
(74) *Attorney, Agent, or Firm* — Mark Malek; Stephen Bullock; Widerman Malek, PL

(57) ABSTRACT

A lighting device may include a base, a housing, a driver circuit, an optic, a thermally-conductive fluid, a LED filament structure, and a fluid flow generator. The base may have an electrical contact. The housing may be attached to the base at a first end and have an internal cavity. The driver circuit may be positioned within the internal cavity and may be in electrical communication with the electrical contact. The optic may be attached to a second end of the housing and have an inner surface which may define an optical chamber. The thermally-conductive fluid may be positioned within the optical chamber. The LED filament structure may be positioned within the optical chamber and may be in electrical communication with the driver circuit. The fluid flow generator may be positioned in fluid communication with the optical chamber and may be in electrical communication with the driver circuit.

21 Claims, 8 Drawing Sheets

Related U.S. Application Data continuation-in-part of application No. 13/107,782, filed on May 13, 2011, now abandoned, application No. 14/591,521, which is a continuation-in-part of application No. 14/338,942, filed on Jul. 23, 2014, which is a division of application No. 13/739,286, filed on Jan. 11, 2013, now Pat. No. 8,835,945.

(51) Int. Cl.

| | |
|---|---|
| ***F21V 29/503*** | (2015.01) |
| ***F21V 23/00*** | (2015.01) |
| ***F21V 29/02*** | (2006.01) |
| ***F21V 29/65*** | (2015.01) |
| ***F21V 29/78*** | (2015.01) |
| ***F21K 99/00*** | (2016.01) |
| *F21Y 101/02* | (2006.01) |

(52) U.S. Cl.

CPC ..... *F21V 23/009* (2013.01); *F21V 29/02* (2013.01); *F21V 29/503* (2015.01); *F21V 29/65* (2015.01); *F21V 29/78* (2015.01); *F21Y 2101/02* (2013.01)

(56) References Cited

U.S. PATENT DOCUMENTS 5,704,701 A 1/1998 Kavanagh et al.
5,997,150 A 12/1999 Anderson
6,140,646 A 10/2000 Busta et al.
6,290,382 B1 9/2001 Bourn et al.
6,341,876 B1 1/2002 Moss et al.
6,356,700 B1 3/2002 Strobl
6,358,631 B1 3/2002 Forrest et al.
6,365,270 B2 4/2002 Forrest et al.
6,542,671 B1 4/2003 Ma et al.
6,548,956 B2 4/2003 Forrest et al.
6,561,656 B1 5/2003 Kojima et al.
6,594,090 B2 7/2003 Kruschwitz et al.
6,596,134 B2 7/2003 Forrest et al.
6,733,135 B2 5/2004 Dho
6,767,111 B1 7/2004 Lai
6,817,735 B2 11/2004 Shimizu et al.
6,870,523 B1 3/2005 Ben-David et al.
6,871,982 B2 3/2005 Holman et al.
6,893,140 B2 5/2005 Storey et al.
6,945,672 B2 9/2005 Du et al.
6,964,501 B2 11/2005 Ryan
6,967,761 B2 11/2005 Starkweather et al.
6,974,713 B2 12/2005 Patel et al.
7,042,623 B1 5/2006 Huibers et al.
7,070,281 B2 7/2006 Kato
7,072,096 B2 7/2006 Holman et al.
7,075,707 B1 7/2006 Rapaport et al.
7,083,304 B2 8/2006 Rhoads et al.
7,173,369 B2 2/2007 Forrest et al.
7,178,941 B2 2/2007 Roberge et al.
7,184,201 B2 2/2007 Duncan
7,246,923 B2 7/2007 Conner
7,255,469 B2 8/2007 Wheatley et al.
7,261,453 B2 8/2007 Morejon et al.
7,285,801 B2 10/2007 Eliashevich et al.
7,289,090 B2 10/2007 Morgan
7,300,177 B2 11/2007 Conner
7,303,291 B2 12/2007 Ikeda et al.
7,306,352 B2 12/2007 Sokolov et al.
7,325,956 B2 2/2008 Morejon et al.
7,342,658 B2 3/2008 Kowarz et al.
7,344,279 B2 3/2008 Mueller et al.
7,344,280 B2 3/2008 Panagotacos et al.
7,349,095 B2 3/2008 Kurosaki
7,353,859 B2 4/2008 Stevanovic et al.
7,382,091 B2 6/2008 Chen
7,382,632 B2 6/2008 Alo et al.
7,400,439 B2 7/2008 Holman
7,427,146 B2 9/2008 Conner
7,429,983 B2 9/2008 Islam
7,434,946 B2 10/2008 Huibers
7,438,443 B2 10/2008 Tatsuno et al.
7,476,016 B2 1/2009 Kurihara
7,520,642 B2 4/2009 Holman et al.
7,530,708 B2 5/2009 Park
7,537,347 B2 5/2009 Dewald
7,540,616 B2 6/2009 Conner
7,556,406 B2 7/2009 Petroski et al.
7,598,686 B2 10/2009 Lys et al.
7,605,971 B2 10/2009 Ishii et al.
7,626,755 B2 12/2009 Furuya et al.
7,670,021 B2 3/2010 Chou
7,677,736 B2 3/2010 Kazasumi et al.
7,684,007 B2 3/2010 Hull et al.
7,703,943 B2 4/2010 Li et al.
7,709,811 B2 5/2010 Conner
7,714,504 B2 5/2010 Forrest et al.
7,719,766 B2 5/2010 Grasser et al.
7,766,490 B2 8/2010 Harbers et al.
7,771,085 B2 8/2010 Kim
7,819,556 B2 10/2010 Heffington et al.
7,828,465 B2 11/2010 Roberge et al.
7,832,878 B2 11/2010 Brukilacchio et al.
7,834,867 B2 11/2010 Sprague et al.
7,835,056 B2 11/2010 Doucet et al.
7,845,823 B2 12/2010 Mueller et al.
7,883,241 B2 2/2011 Ho
7,884,377 B2 2/2011 Onushkin et al.
7,889,430 B2 2/2011 El-Ghoroury et al.
7,906,722 B2 3/2011 Fork et al.
7,910,395 B2 3/2011 Shei et al.
7,928,565 B2 4/2011 Brunschwiler et al.
7,976,205 B2 7/2011 Grötsch et al.
8,008,680 B2 8/2011 Yu et al.
8,047,660 B2 11/2011 Penn et al.
8,061,857 B2 11/2011 Liu et al.
8,070,302 B2 12/2011 Hatanaka et al.
8,070,324 B2 12/2011 Kornitz et al.
8,083,364 B2 12/2011 Allen
8,096,668 B2 1/2012 Abu-Ageel
8,193,018 B2 6/2012 Cok
8,201,968 B2 6/2012 Maxik et al.
8,272,763 B1 9/2012 Chinnam et al.
8,297,798 B1 10/2012 Pittman et al.
8,319,408 B1 11/2012 Horng
8,324,803 B2 12/2012 Forrest et al.
8,337,063 B2 12/2012 Nagasawa et al.
8,337,066 B2 12/2012 Yeh et al.
8,408,748 B2 * 4/2013 Janik ..... F21V 23/005 315/35
8,419,249 B2 4/2013 Yatsuda et al.
8,427,590 B2 4/2013 Raring et al.
8,461,599 B2 6/2013 Tsang
8,531,126 B2 9/2013 Kaihotsu et al.
8,585,242 B2 11/2013 Walczak et al.
8,608,348 B2 12/2013 Maxik et al.
8,672,518 B2 3/2014 Boomgaarden et al.
8,735,189 B2 5/2014 Han
8,835,945 B2 9/2014 Maxik et al.
2002/0151941 A1 10/2002 Okawa et al.
2004/0008525 A1 * 1/2004 Shibata ..... F21K 9/135 313/271
2005/0033119 A1 2/2005 Okawa et al.
2005/0156501 A1 * 7/2005 Kasak ..... H01K 3/06 313/343
2007/0041167 A1 2/2007 Nachi
2008/0232116 A1 9/2008 Kim
2009/0141506 A1 6/2009 Lan et al.
2009/0268468 A1 10/2009 Liu
2010/0027270 A1 * 2/2010 Huang ..... F21K 9/135 362/310
2010/0027276 A1 * 2/2010 Kornitz ..... F21V 29/02 362/373
2010/0091486 A1 * 4/2010 Wu ..... F21K 9/00 362/234
2010/0155766 A1 6/2010 Ku

(56) References Cited

U.S. PATENT DOCUMENTS

| | | | | |
|---|---|---|---|---|
| 2010/0207501 | A1* | 8/2010 | Radermacher | F21V 29/677 313/46 |
| 2010/0207502 | A1* | 8/2010 | Cao | F21K 9/135 313/46 |
| 2010/0213881 | A1 | 8/2010 | Imai | |
| 2010/0301728 | A1 | 12/2010 | Helbing et al. | |
| 2010/0315320 | A1 | 12/2010 | Yoshida | |
| 2010/0321641 | A1 | 12/2010 | Van Der Lubbe | |
| 2011/0080732 | A1 | 4/2011 | Chen | |
| 2011/0205738 | A1 | 8/2011 | Peifer et al. | |
| 2012/0002411 | A1 | 1/2012 | Ladewig | |
| 2012/0044642 | A1* | 2/2012 | Rodriguez | F21V 29/027 361/692 |
| 2012/0051041 | A1 | 3/2012 | Edmond et al. | |
| 2012/0106144 | A1 | 5/2012 | Chang | |
| 2012/0120659 | A1 | 5/2012 | Lopez | |
| 2012/0201034 | A1 | 8/2012 | Li | |
| 2012/0235181 | A1 | 9/2012 | Matsuda et al. | |
| 2012/0262902 | A1 | 10/2012 | Pickard et al. | |
| 2012/0285667 | A1 | 11/2012 | Maxik et al. | |
| 2012/0327650 | A1 | 12/2012 | Lay et al. | |
| 2013/0021792 | A1 | 1/2013 | Snell et al. | |
| 2013/0044490 | A1* | 2/2013 | Kuo | F21V 29/02 362/294 |
| 2013/0050979 | A1 | 2/2013 | Van De Ven et al. | |
| 2013/0223055 | A1 | 8/2013 | Holland et al. | |
| 2014/0268827 | A1* | 9/2014 | Schwarz | F21K 9/10 362/373 |

FOREIGN PATENT DOCUMENTS

| | | |
|---|---|---|
| WO | WO 03073518 | 9/2003 |
| WO | WO 2008091837 | 7/2008 |
| WO | WO2008137732 | 11/2008 |
| WO | WO 2009040703 | 4/2009 |
| WO | WO 2012031533 | 3/2012 |
| WO | WO 2012158607 | 11/2012 |

OTHER PUBLICATIONS

G30Dx5DF LED Filament Bulb G30 LED Candelabra Bulb with 5 Watt Example of arrangment market available LED filament bulb.*

Arthur P. Fraas, Heat Exchanger Design, 1989, p. 60, John Wiley & Sons, Inc., Canada.

EP International Search Report for Application No. 10174449.8; (Dec. 14, 2010).

H. A El-Shaikh, S. V. Garimella, "Enhancement of Air Jet Impingement Heat Transfer using Pin-Fin Heat Sinks", D IEEE Transactions on Components and Packaging Technology, Jun. 2000, vol. 23, No. 2.

J. Y. San, C. H. Huang, M. H, Shu, "Impingement cooling of a confined circular air jet", In t. J. Heat Mass Transf., 1997. pp. 1355-1364, vol. 40.

N. T. Obot, W. J. Douglas, A S. Mujumdar, "Effect of Semi-confinement on Impingement Heat Transfer", Proc. 7th Int. Heat Transf. Conf., 1982, pp. 1355-1364. vol. 3.

S. A Solovitz, L. D. Stevanovic, R. A Beaupre, "Microchannels Take Heatsinks to the Next Level", Power Electronics Technology, Nov. 2006.

Yongmann M. Chung, Kai H. Luo, "Unsteady Heat Transfer Analysis of an Impinging Jet", Journal of Heat Transfer—Transactions of the ASME, Dec. 2002, pp. 1039-1048, vol. 124, No. 6.

United States Patent and Trademark Office's Office Action dated Dec. 31, 2014 for related U.S. Appl. No. 14/084,118 (22 pages).

United States Patent and Trademark Office's Notice of Allowance dated May 20, 2015 for related U.S. Appl. No. 14/084,118 (8 pages).

United States Patent and Trademark Office's Office Action dated Feb. 4, 2013 for related U.S. Appl. No. 13/107,782 (17 pages).

United States Patent and Trademark Office's Final Office Action dated May 29, 2013 for related U.S. Appl. No. 13/107,782 (11 pages).

United States Patent and Trademark Office's Advisory Action dated Aug. 8, 2013 for related U.S. Appl. No. 13/107,782 (3 pages).

PCT International Search Report dated Nov. 22, 2012 for related PCT patent application published as WO2012/158607 (4 pages).

PCT Written Opinion dated Nov. 13, 2013 for related PCT patent application published as WO2012/158607 (5 pages).

PCT International Preliminary Report on Patentability dated Nov. 19, 2013 for related PCT patent application published as WO2012/158607 (6 pages).

United States Patent and Trademark Office's Office Action dated Jun. 14, 2013 for related U.S. Appl. No. 13/461,333 (14 pages).

United States Patent and Trademark Office's Notice of Allowance dated Aug. 14, 2013 for related U.S. Appl. No. 13/461,333 (9 pages).

United States Patent and Trademark Office's Office Action dated Sep. 21, 2015 for related U.S. Appl. No. 14/338,942 (19 pages).

United States Patent and Trademark Office's Office Action dated Nov. 24, 2015 for related U.S. Appl. No. 14/338,942 (3 pages).

* cited by examiner

SYSTEM FOR ACTIVELY COOLING AN LED FILAMENT AND ASSOCIATED METHODS

RELATED APPLICATIONS

This application is a continuation-in-part and claims the benefit under 35 U.S.C. §120 of U.S. patent application Ser. No. 14/084,118 filed on Nov. 19, 2013 and titled Sealed Electrical Device with Cooling System which, in turn, is a continuation of U.S. patent application Ser. No. 13/461,333 filed on May 1, 2012, now U.S. Pat. No. 8,608,348 issued on Dec. 17, 2013, and titled Sealed Electrical Device with Cooling System and Associated Methods, which, in turn, is a continuation-in-part of U.S. patent application Ser. No. 13/107,782 filed on May 13, 2011 and titled Sound Baffling Cooling System for LED Thermal Management and Associated Methods, now abandoned, and also incorporated the disclosure of U.S. patent application Ser. No. 12/775,310 filed May 6, 2010, now U.S. Pat. No. 8,201,968 issued on Jun. 19, 2012, titled Low Profile Light, which, in turn, claimed the benefit of U.S. Provisional Patent Application Ser. No. 61/248,665 filed on Oct. 5, 2009, the entire contents of each of which are incorporated herein by reference herein in their entireties except to the extent disclosure therein is inconsistent with disclosure herein. This application is also a continuation-in-part and claims the benefit under 35 U.S.C. §120 of U.S. patent application Ser. No. 14/338,942 filed on Jul. 23, 2014 and titled Serially-Connected Light Emitting Diodes, Methods of Forming Same, and Luminaires Containing Same which in turn is a divisional of U.S. patent application Ser. No. 13/739,286 filed Jan. 11, 2013, now U.S. Pat. No. 8,835,945 issued on Sep. 16, 2014, and titled Serially-Connected Light Emitting Diodes, Methods of Forming Same, and Luminaires Containing Same, the entire contents of each of which are incorporated herein by reference herein in their entireties except to the extent disclosure therein is inconsistent with disclosure herein.

FIELD OF THE INVENTION

The present invention relates to systems and methods for actively cooling lighting and, more specifically, to cooling light emitting diode filaments.

BACKGROUND

Digital lighting technologies such as light-emitting diodes (LEDs) offer significant advantages over incandescent and fluorescent lamps. These advantages include, but are not limited to, better lighting quality, longer operating life, and lower energy consumption. LEDs also are being designed to have more desirable color temperatures than do traditional lamps. Moreover, LEDs do not contain mercury or any other toxic substance. Consequently, a market exists for LED-based lamps as retrofits for legacy lighting fixtures.

A number of design challenges and costs are associated with replacing traditional lamps with LED illumination devices. These design challenges include thermal management, installation ease, and manufacturing cost control.

Thermal management describes a system's ability to draw heat away from an LED. Lighting technology that employs LEDs suffers shortened lamp and fixture life and decreased performance when operating in high-heat environments. Moreover, when operating in a space-limited enclosure with limited ventilation, such as, for example, a can light fixture, the heat generated by an LED and its attending circuitry itself can cause damage to the LED.

Cooling systems for lighting devices have traditionally employed passive cooling technology, such as a heat sink thermally coupled to a lighting device. In some other systems, a fan has also been employed to direct a flow of air through the heat sink, thereby accelerating the dissipation of heat from the heat sink and, therefore, from the lighting device. A heat sink may be used to transfer heat from a solid material to a fluid medium such as, for example, air. One of the challenges in using a heat sink, however, is that of absorbing and dissipating heat at a sufficient rate with respect to the amount of heat being generated by the LED. If the heat sink does not have the optimal amount of capacity, the heat can gradually build up behind the LED and cause damage to the components.

Compared to incandescent and fluorescent lamps, LED-based lighting solutions have relatively high manufacturing and component costs. These costs are often compounded by a need to replace or reconfigure a light fixture that is designed to support incandescent or fluorescent lamps to instead support LEDs. Consequently, the cost of adoption of digital lighting technology, particularly in the consumer household market, is driven by design choices for retrofit LED-based lamps that impact both cost of manufacture and ease of installation.

Traditional cooling systems for lighting devices have also relied upon a supply of air from the environment to blow onto and transfer heat away from the lighting device. As a result, proposed solutions in the prior art have included vents, apertures, or other openings generally in the housing of the lighting device to provide a supply of cool air from the environment.

The introduction of air from the environment into the housing of a lighting device may also result in the introduction of contaminants. Substances carried along with the environmental air can inhibit and impair the operation of the lighting device, causing faulty performance by, or early failure of, the digital device. Moreover, the accumulation of contaminants in the cooling system can result in a reduction in efficacy of the cooling system. Accordingly, there is a need in the art for a cooling system that can operate in a system sealed from the environment, hence without a supply of air external to the sealed system.

Sealed cooling systems are known in the art. As an example, a Peltier device can be used to cool a digital system without a supply of external air. However, Peltier devices are expensive to produce and use electricity inefficiently in comparison to more traditional cooling systems. Accordingly, there is a need for a cooling system in a sealed environment that is inexpensive to produce and is energy efficient.

Other proposed solutions have included the use of a sealed system containing a fluid thermally coupled to a digital device in association with a radiator where fluid warmed by the digital device radiates the heat into the environment. However, these systems require significant amounts of space in order to pipe the fluid between the radiator and the thermal coupling with the digital device. Accordingly, there is a need for a cooling system that can operate in a space-limited sealed system.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention advantageously provide a cooling system for a lighting device in a sealed environment that is inexpensive to produce and is energy efficient. Embodiments of the present invention also advantageously provide a lighting device that includes a cooling system that can operate in a space-limited sealed system.

These and other objects, features, and advantages according to the present invention are provided by a lighting device that may include a base, a housing, a driver circuit, an optic, a thermally-conductive fluid, a light-emitting diode (LED) filament structure, and a fluid flow generator. The base may have an electrical contact and the housing may be attached to the base at a first end and may have an internal cavity. The driver circuit may be positioned within the internal cavity and may be in electrical communication with the electrical contact. The optic may have an inner surface which may define an optical chamber. The optic may be attached to a second end of the housing. The thermally-conductive fluid and the LED filament structure may be positioned within the optical chamber and the LED filament structure may be in electrical communication with the driver circuit. The fluid flow generator may be positioned in fluid communication with the optical chamber and may be in electrical communication with the driver circuit. The fluid flow generator may be adapted to generate a flow of the thermally-conductive fluid in the direction of the LED filament structure.

In some embodiments, the LED filament structure may include a plurality of LED dies and the flow of thermally-conductive fluid generated by the fluid flow generator may be directed towards at least one LED die of the LED filament structure. The plurality of LED dies may be arranged so as to define a light-emitting length of the LED filament structure and the flow of thermally-conductive fluid generated by the fluid flow generator may be directed to be incident upon the entire light-emitting length of the LED filament structure. The LED filament structure may also define a longitudinal axis and the flow of thermally-conductive fluid may be in a direction generally perpendicular to the longitudinal axis of the LED filament structure or generally parallel to the longitudinal axis of the LED filament structure.

The optical chamber and the internal cavity may be in fluid communication with each other and the thermally-conductive fluid may be positioned within both the optical chamber and the internal cavity. The fluid flow generator may be positioned so as to generate a flow of the thermally-conductive fluid in the direction of the driver circuit and/or the LED filament structure and the fluid flow generator may be positioned such that the driver circuit may be intermediate the fluid flow generator and the LED filament structure. The fluid flow generator may be positioned generally intermediate the driver circuit and the LED filament structure.

The lighting device may further include a heat sink which may be positioned in thermal communication with the LED filament structure and/or the driver circuit. The fluid flow generator may be positioned to direct the flow of thermally conductive fluid towards the heat sink, the driver circuit, and/or the LED filament structure. The fluid flow generator may be a microblower device. The thermally-conductive fluid may be air, helium, neon, and/or nitrogen. The optical chamber and the internal cavity may combine to define an interior volume and the interior volume may be fluidically sealed.

The LED filament structure may have a curvature that may be approximately equal to a curvature of the inner surface of the optic. The LED filament structure may be configured to generally conform to the curvature of the optic that may conform to a bulb configuration selected from the group consisting of A19, A15, A21, ST19, ST15, S21, S11, C7, G25, G20, PAR30, PAR20, BR30, BR40, and R20. Those skilled in the art will appreciate that any other bulb configuration may be selected and the LED filament structure may be configured to generally conform to the curvature of the optic that may conform to the selected bulb configuration.

The plurality of LED dies and the LED filament structure may also be configured to emit light away from the lighting device semi-hemispherically, hemispherically, or spherically. The lighting device may further include a flow redirection structure which may be configured to redirect fluid flow incident thereupon about the optical chamber and the flow of thermally-conductive fluid which may be generated by the fluid flow generator in the direction of the flow redirection structure. The flow redirection structure may be configured to redirect fluid flow incident thereupon about at least a portion of the optical chamber. The flow redirection structure may be positioned proximate to an apex of the optical chamber and the fluid flow generator may be positioned proximate to a nadir of the optical chamber. The flow redirection structure may also be configured to redirect at least a portion of the fluid flow incident thereupon generally in the direction of the fluid flow generator.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

Figure 1:
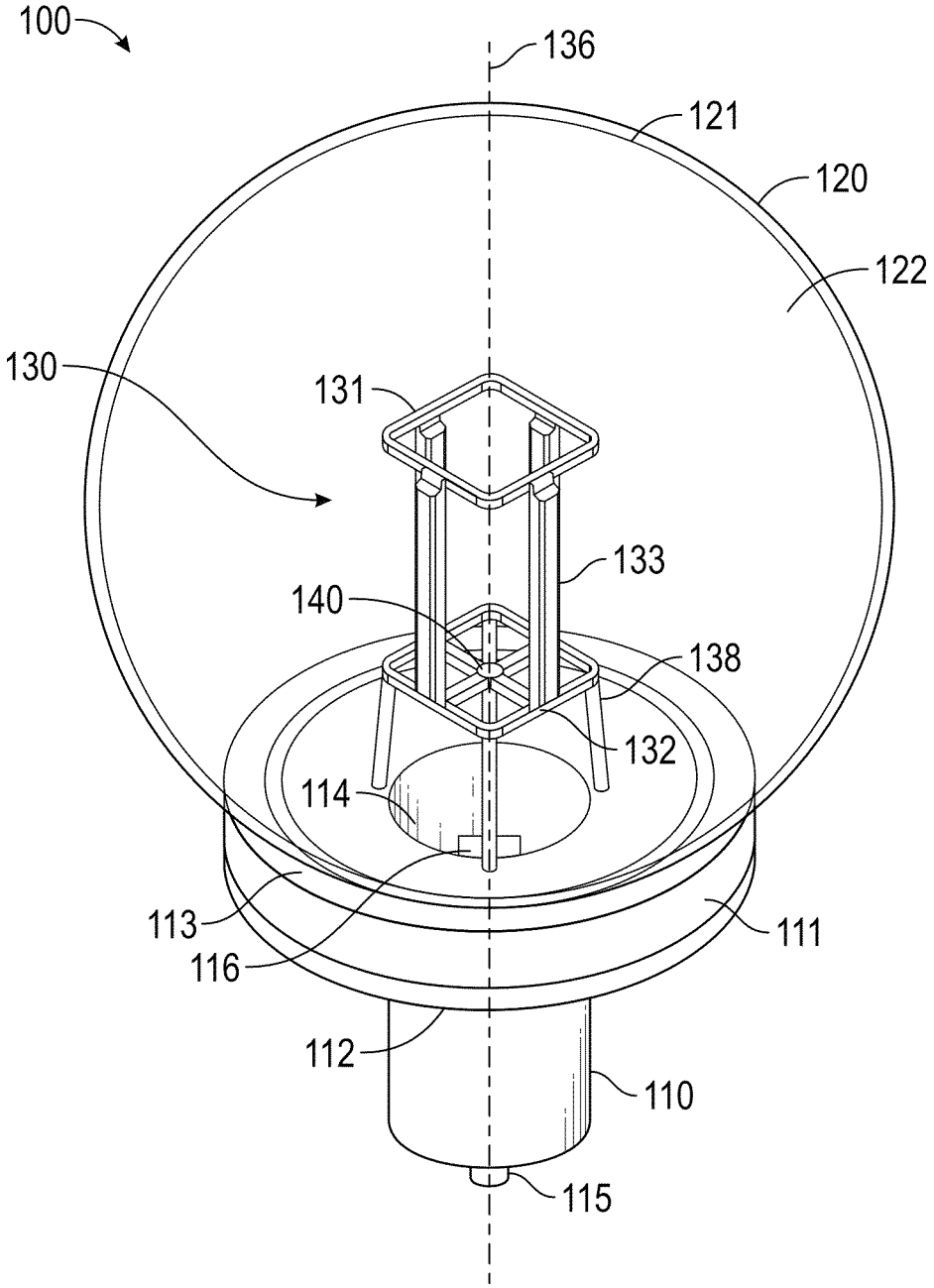
FIG. 1 is a perspective view of a lighting device according to an embodiment of the present invention.
Figure 2:
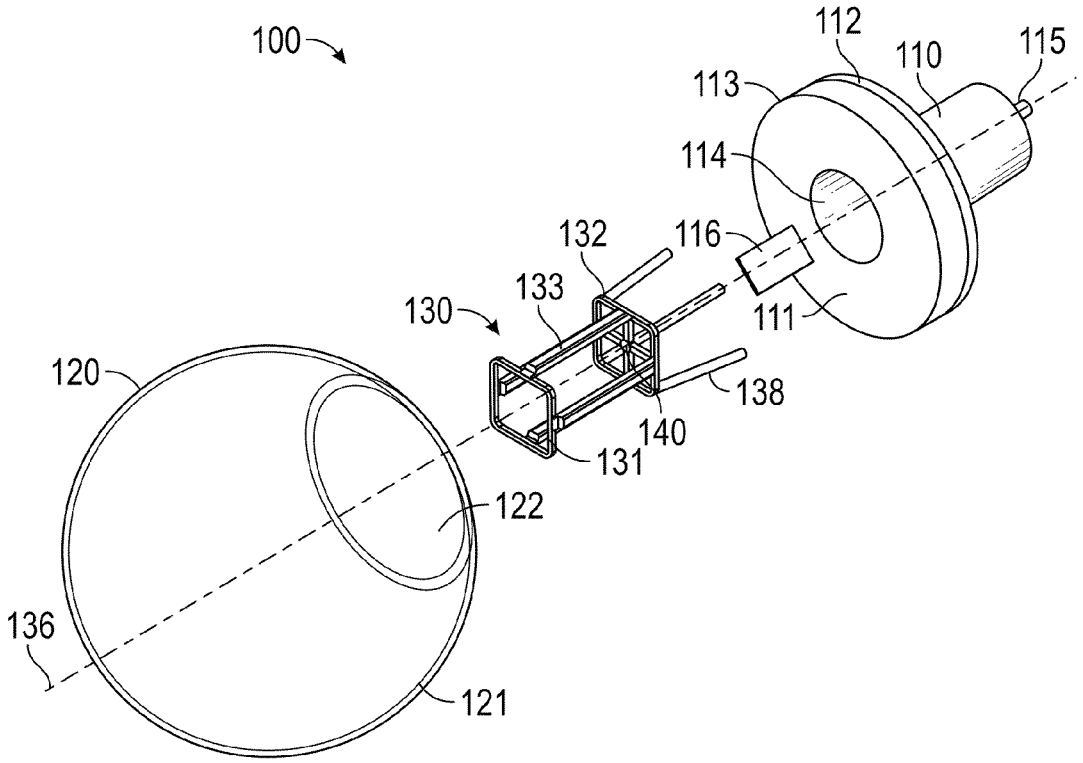
FIG. 2 is an exploded perspective view of the lighting device illustrated in FIG. 1.
Figure 3:
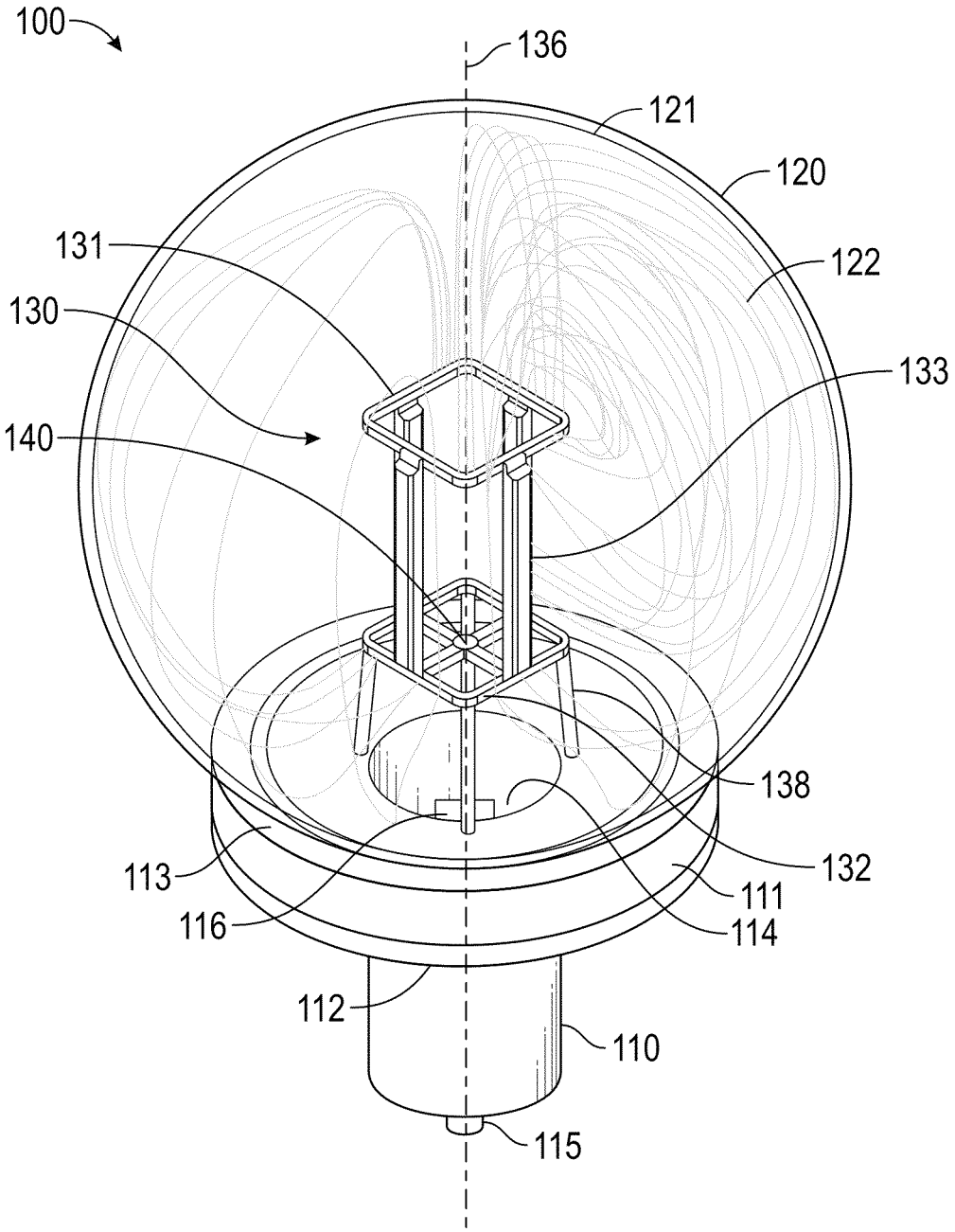
FIG. 3 is a perspective view of the lighting device illustrated in FIG. 1 showing contours of a thermally-conductive fluid flow from a filament structure of the lighting device with a fluid flow generator being operational.

Referring to FIGS. 1-3, an embodiment of the present invention, as shown and described by the various figures and accompanying text, provides a lighting device 100 that may include a base 110, a housing 111, a driver circuit 116, an optic 120, a thermally-conductive fluid (shown in FIG. 3 only via contour lines), a light-emitting diode (LED) filament structure 130, and a fluid flow generator 140. The housing 111 may include a first end 112 and a second end 113, and may further include an internal cavity 114. The housing 111 may be fabricated of a thermally-conductive material, including, but not limited to, metals, metal alloys, ceramics, thermally-conductive polymers, and the like. Additionally, the base 110 may include an electrical contact 115. The housing 111 may be attached to the base 110 at the first end 112. The driver circuit 116 may be positioned within the internal cavity 114 and may be positioned in electrical communication with the electrical contact 115. The optic 120 may include an inner surface 121 which may define an optical chamber 122. Furthermore, the optic 120 may be attached to the second end 113 of the housing 111. The optic 120 may be fabricated of a transparent or translucent and thermally-conductive material. The thermally-conductive fluid and the LED filament structure 130 may be positioned within the optical chamber 122. Additionally, the LED filament structure 130 may be in electrical communication with the driver circuit 116.

The fluid flow generator 140 may be positioned in fluid communication with the optical chamber 122 and may be in electrical communication with the driver circuit 116. The fluid flow generator 140 may be adapted to generate a flow of the thermally-conductive fluid, and may be positioned such that the flow of thermally conductive fluid generated thereby is in the direction of the LED filament structure 130. The fluid flow generator may be any type of device capable of generating a fluid flow as is known in the art, including, but not limited to, microblowers.

The LED filament structure 130 may include an upper bracket 131, a lower bracket 132, and a plurality of LED filaments 133. The plurality of LED filaments 133 may include an LED die 134. The flow of thermally-conductive fluid, which may be generated by the fluid flow generator 140, may be directed towards at least one LED die 134 of the LED filament structure 130. As shown in FIGS. 1-3, the plurality of LED filaments 133 may be positioned between the upper bracket 131 and the lower bracket 132. Those skilled in the art will appreciate that any number of brackets may be used and although FIGS. 1-3 show an upper bracket 131 and a lower bracket 132, the present invention contemplates the use of one or more brackets.

The LED filament structure 130 may further include a filament support 138. The filament support 138 may be a separate structure attached to the LED filament structure 130, or it may be integrally formed with the LED filament structure 130. The filament support 138 may be a bracket or a combination of brackets attached to the housing 111, the second end 112, the LED filament structure 130, the upper bracket 131, the lower bracket 132, the intermediate bracket 137, the fluid flow generator 140, and/or the flow redirection structure 150. For example, and without limitation, the filament support 138 may be attached to the second end 113 of the housing 111 and the lower bracket 132. For example, and without limitation, as shown in FIGS. 1-3 and 5-8, the filament support 138 may be four brackets. Those skilled in the art will appreciate that any number of brackets may be used. The present invention contemplates the use of one or more brackets. The present invention further contemplates any other number of configurations of the filament support 138 and any other number of placements of the filament support 138 to position the LED filament structure 130 as desired.

Referring to FIGS. 1-3, the upper bracket 131 and the lower bracket 132 may be generally square in shape. Those skilled in the art will appreciate that the upper bracket 131 and the lower bracket 132 may be square, rectangular, circular, ovular, polygonal, or any combination thereof.

Figure 4:
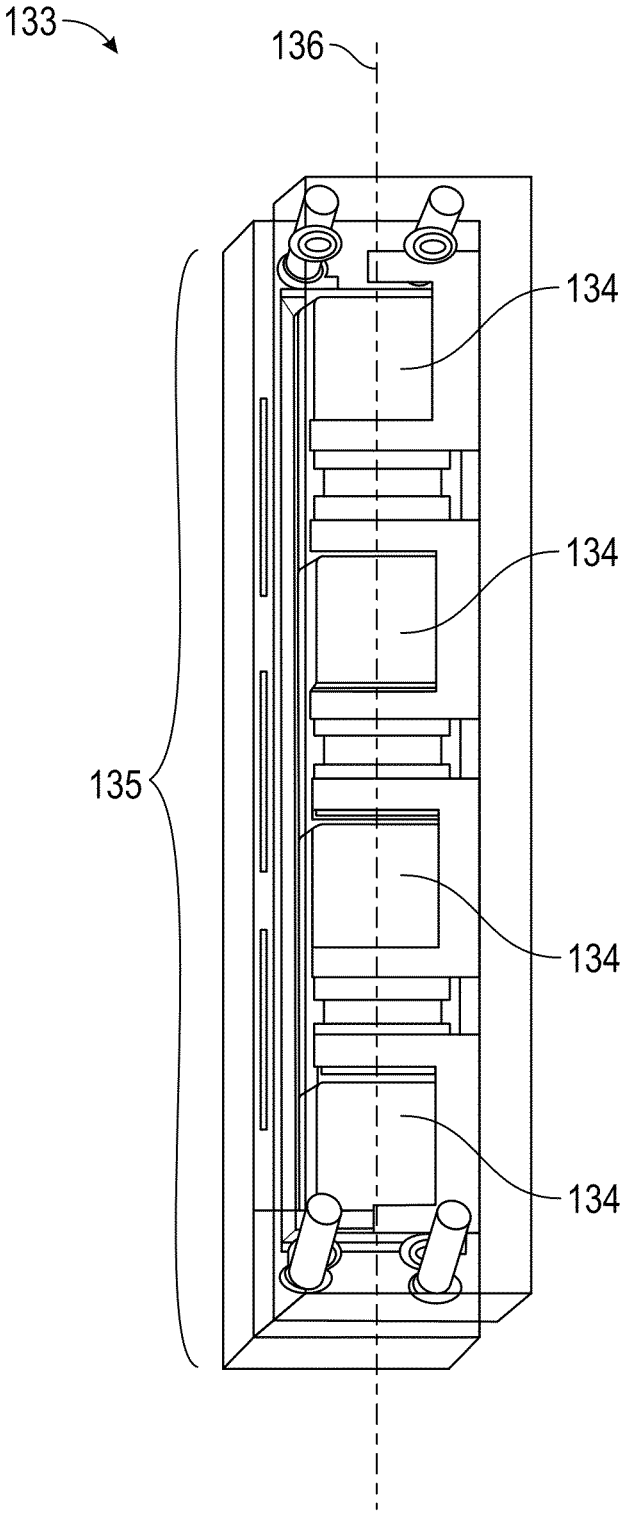
FIG. 4 is a schematic perspective view of a light emitting diode filament of the lighting device illustrated in FIG. 1.

Referring now additionally to FIG. 4, the plurality of LED dies 134 may be arranged so as to define a light-emitting length 135 of the LED filament 133. The flow of thermally-conductive fluid generated by the fluid flow generator 140 may be directed to be incident upon the entire light-emitting length 135 of the LED filament 133.

While incident upon the LED filament structure 130, thermal energy generated by the LED dies 134 or any other heat-generating element of the LED filament structure 130 may be transferred to the thermally-conductive fluid. The thermally conductive fluid may have its temperature elevated from an initial temperature below the temperature of the LED dies 134 to a temperature at or near the present temperature of the LED dies 134. The transfer of thermal energy will reduce the operating temperature of the LED dies 134, thereby reducing the likelihood and/or extent of thermally-induced reduction in operating life of the LED dies 134. Accordingly, the inner surface 121 of the optic 120 may be configured to maximize thermals transfer from the thermally-conductive fluid while still conforming to the geometric requirements of the standard bulb size that the lighting device 100 must conform to.

The LED filament structure 130 and/or the LED filament 133 may also define a longitudinal axis 136 and the flow of thermally-conductive fluid may be in a direction generally perpendicular to the longitudinal axis 136 of the LED filament structure 130 and/or the LED filament 133 or generally parallel to the longitudinal axis 136 of the LED filament structure 130 and/or the LED filament 133. Generally perpendicular to the longitudinal axis 136 is meant to include perpendicular to the longitudinal axis 136 and within 30 degrees of perpendicular to the longitudinal axis 136. Generally parallel to the longitudinal axis 136 is meant to include parallel to the longitudinal axis 136 and within 30 degrees of parallel to the longitudinal axis 136. In the present invention, the flow of thermally-conductive fluid, therefore, may include any flow of thermally-conductive fluid that is directed along a length of the longitudinal axis 136 or along a perpendicular axis to the longitudinal axis 136. Those skilled in the art will appreciate that the plurality of LED dies 134 may include one or more LED dies 134, that the lighting device 100 may include one or more LED filament structures 130, and that the LED filament structures 130 may include one or more LED filaments 133.

Additionally, the LED filament structure 130 may be formed of a thermally conductive material. Accordingly, the LED filament structure 130 may conduct thermal energy away from heat-generating elements thereof, such as the LED dies 134. This may simultaneously reduce the operating temperature of the LED dies 134 while increasing the surface area from which the thermally-conductive fluid may absorb thermal energy, thereby increasing the thermal dissipation capacity of the LED filament structure 130 than if the LED filament structure 130 were formed of non-thermally conductive material. Additionally, in some embodiments, the LED filament structure 130 may be formed of electrically non-conductive material.

For example and without limitation, as shown in FIG. 4, the LED filament 133 may include a plurality of LED dies 134. More particularly, the LED dies 134 may be provided by four LED dies 134, but one, two, three, or any other number of LED dies is contemplated by the present invention, while still accomplishing the goals, features and objectives thereof. As shown in FIGS. 1-3, the lighting device 100 may include the LED filament structure 130 with four LED filaments 133, but one, two, three, or any other number is contemplated by the present invention while still accomplishing the goals, features and objectives thereof. In addition, the shape of the LED filaments 133 may be rectangular. Those skilled in the art will appreciate that the LED filaments 133 may be square, rectangular, circular, or have any other shaped as may be understood by those skilled in the art after having had the benefit of reading this disclosure. The LED filaments 133 may also be any combination of shapes and the LED filament structure 130 may include any number of LED filaments 133 attached at any number of angles. For example and without limitation, as shown in FIGS. 1-3, four LED filaments 131 may be attached to the upper bracket 131 and the lower bracket 132. The fluid flow generator 140 may be positioned on the lower bracket 132 or the upper bracket 131. Those skilled in the art will appreciate that the lighting device 100 may include any number of upper brackets 131 and/or lower brackets 132.

The optical chamber 122 and the internal cavity 114 may be in fluid communication with each other. Additionally, the thermally-conductive fluid may be positioned within both the optical chamber 122 and the internal cavity 114. The lighting device 100 may further include a heat sink which may be positioned in thermal communication with the LED filament structure 130 and/or the driver circuit 116.

In some embodiments, the base 110 and/or the housing 111 may be the heat sink. Additionally, the base 110 and/or the housing 111 may include a fin or a plurality of fins that may be the heat sink, may be a portion of the heat sink, or may be in addition to the heat sink. For example, and without limitation, the heat sink may include a plurality of fins connected to the bottom of the base 110 or the bottom of the housing 111. Furthermore, any portion of the base 110 and/or the housing 111 may be the heat sink.

Additional details relating to heat sinks incorporated into a lighting device are provided in U.S. patent application Ser. No. 13/107,782 titled Sound Baffling Cooling System for LED Thermal Management and Associated Methods filed May 13, 2011, U.S. Pat. No. D711,560 titled Lamp Having a Modular Heat Sink filed Oct. 4, 2012, U.S. Pat. No. D689,633 titled Lamp with a Modular Heat Sink filed Sep. 10, 2012, U.S. patent application Ser. No. 29/437,877 titled Lamp Having a Modular Heat Sink filed Nov. 21, 2012, U.S. Pat. No. D691,568 titled Modular Heat Sink filed Sep. 28, 2012, U.S. patent application Ser. No. 13/832,900 titled Luminaire with Modular Cooling System and Associated Methods filed Mar. 15, 2013 which, in turn, claims the benefit under 35 U.S.C. §119(e) of U.S. Provisional Patent Application Ser. No. 61/715,075 titled Lighting Device With Integrally Molded Cooling System and Associated Methods filed Oct. 17, 2012, U.S. patent application Ser. No. 13/875,855 titled Luminaire Having a Vented Enclosure filed May 2, 2013 which, in turn, claims the benefit under 35 U.S.C. §119(e) of U.S. Provisional Patent Application Ser. No. 61/642,257 titled Luminaire Having a Vented Enclosure filed May 3, 2012, and U.S. patent application Ser. No. 13/829,832 titled Luminaire with Prismatic Optic filed Mar. 14, 2013 which, in turn, claims the benefit under 35 U.S.C. §120 of U.S. patent application Ser. No. 13/739,054 titled Luminaire with Prismatic Optic filed Jan. 11, 2013, the entire contents of each of which are incorporated by reference.

In some embodiments, the lighting device 100 may further comprise power circuitry (not shown). The power circuitry may be configured to electrically communicate with an electrical power supply associated with the lighting device 100 through, for example, and without limitation, the electrical contact 115. Such an electrical power supply may be a power grid or a light socket. The power circuitry may be configured to receive electrical power from the electrical power supply and convert, condition, and otherwise alter the electrical power received from the electrical power supply for use by the various electrical elements of the lighting device 100. For example, and without limitation, the power circuitry may be configured to convert AC power to DC power. In some embodiments, the power circuitry may be comprised by a control circuitry, such as the driver circuit 116. The power circuitry may include the electrical contact 115 and/or the driver circuit 116. The power circuitry may be configured to electrically communicate with the the LED filament structure 130, the LED filament 133, the plurality of LED dies 134, and/or the fluid flow generator 140.

The fluid flow generator 140 may be positioned so as to generate a flow of the thermally-conductive fluid in the direction of the driver circuit 116 and/or the LED filament structure 130 and the fluid flow generator 140 may be positioned such that the driver circuit 116 may be intermediate to the fluid flow generator 140 and the LED filament structure 130. Additionally, the fluid flow generator 140 may be positioned generally intermediate the driver circuit 116 and the LED filament structure 130.

The fluid flow generator 140 may be positioned to direct the flow of thermally conductive fluid towards the heat sink, the driver circuit 116, and/or the LED filament structure 130. The fluid flow generator 140 may be a microblower device. Those skilled in the art will appreciate that the lighting device 100 may include any number of fluid flow generators 140. The thermally-conductive fluid may be air, helium, neon, and/or nitrogen. Those skilled in the art will appreciate that thermally-conductive fluid includes any type of fluid.

The optical chamber 122 and the internal cavity 114 may combine to define an interior volume. In some embodiments, the interior volume may be fluidically sealed from the environment surrounding the lighting device 100. The optical chamber 122 and the internal cavity 114 may be fluidically sealed independently from one another. Those skilled in the art will also appreciate that the optical chamber 122 and the internal cavity 114 may be configured so as not to be sealed. This may allow fluid to flow away from the lighting device 100, thereby enhancing the cooling properties thereof.

As shown in FIG. 3, the fluid flow generator 140 may create a cyclical path of thermally-conductive fluid flow by directing the thermally-conductive fluid toward the apex of the inner surface 121 of the optic 120. The thermally-conductive fluid may then be directed along the inner surface 121 of the optic

120 away from the apex and in a downward direction until the thermally-conductive fluid is directed to or near the nadir of the optical chamber 122 and/or to or near the fluid flow generator 140 where the cycle may repeat itself. While traveling within a flow path adjacent to the optic 120, the thermally-conductive fluid may transfer heat to the optic 120 which may then be dissipated into the environment surrounding the optic 120. Once thermally-conductive fluid has flowed through a complete path, its temperature may be reduced from its initial temperature after having thermal energy transferred from the LED filament structure 130 thereto to below the present temperature of at least one of the LED dies 134 and the LED filament structure 130. Upon flowing through the complete path, the fluid flow generator 140 may again direct the thermally-conductive fluid in the direction of the LED filament structure 130, thereby completing and restarting the cyclical flow. Those skilled in the art will appreciate that the fluid flow generator 140 may also direct the thermally-conductive fluid in any number of directions and create any number of different cyclical flow paths within the optical chamber 122 and/or the internal cavity 114.

Each LED die 134 may emit light semi-hemispherically, hemispherically, or spherically. Each LED die 134 may emit light so that light is emitted in every direction away from a given point or a center of the optic or every direction except where the housing and the base will not permit the emission of light. In addition, those skilled in the art will appreciate that the position of the plurality of LED dies 134 and/or the LED filaments 133 within the LED filament structure 130 may emit light semi-hemispherically, hemispherically, or spherically. The position of the plurality of LED dies 134 and/or the LED filaments 133 within the LED filament structure 130 may cause light to be emitted in every direction away from a given point or a center of the optic or in every direction except where the housing 111 and/or the base 110 will not permit the emission of light. In addition, the LED filaments 133, the upper bracket 131, and/or the lower bracket 132 may be curved and/or flexible to emit light in more than a hemispherical direction, such as a spherical or semi-spherical direction.

For example and without limitation, referring to FIGS. 1-3, the LED filament structure 130 may position four LED filaments 133 such that each LED filament 133 is facing 90 degrees away from each adjacent LED filament 133 so that light is emitted generally omnidirectionally. More specifically, light may be emitted in a direction 360 degrees perpendicular to the longitudinal axis 136 and in a direction between parallel to the longitudinal axis 136 at or near the apex of the optic 120 and parallel or near parallel to the longitudinal axis 136 in a direction of the base 110. An emission of light is created thereby that is spherical or semi-spherical, and at least more than hemispherical.

Figure 5:
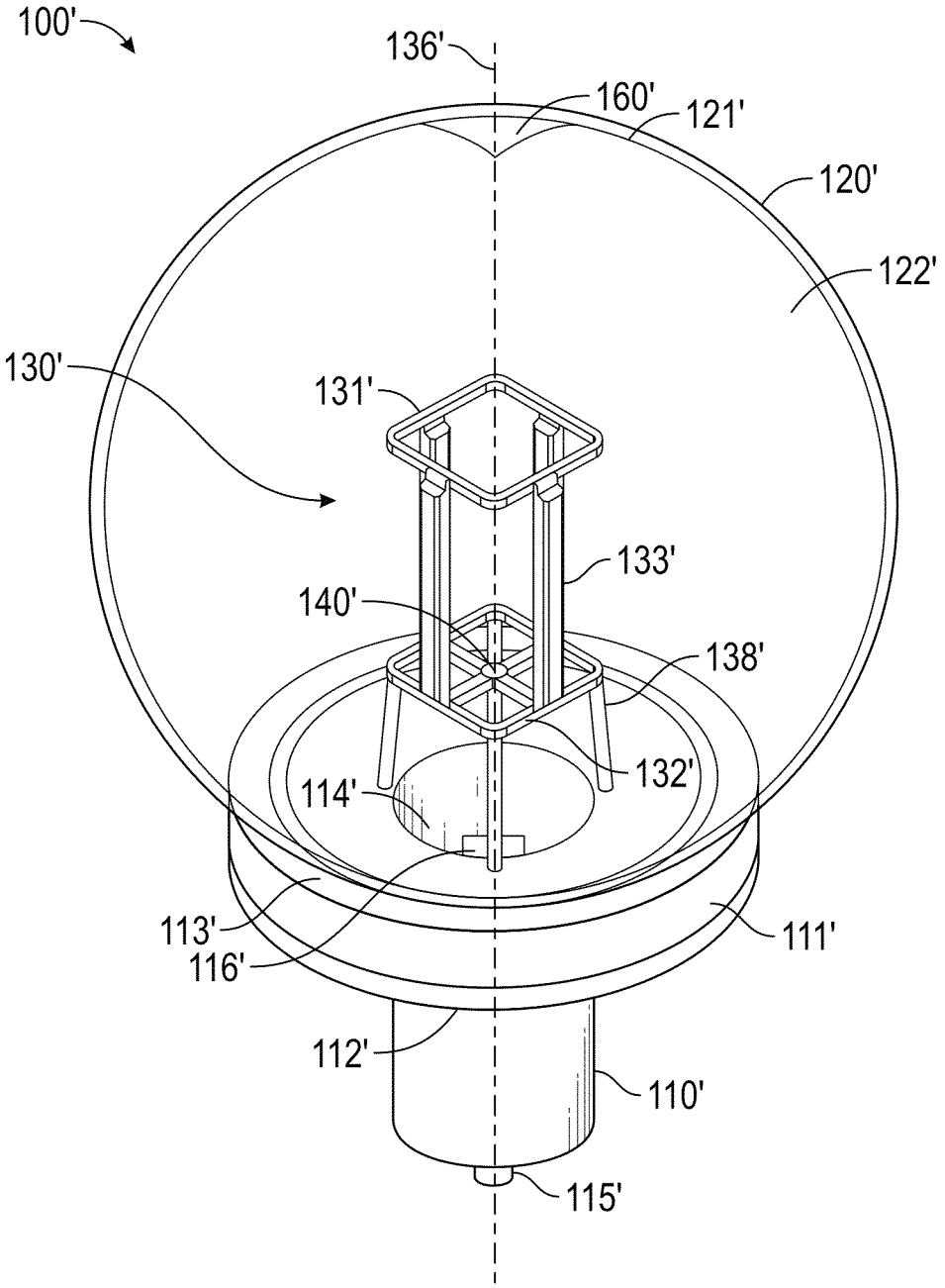
FIG. 5 is a perspective view of a lighting device according to another embodiment of the present invention.

Referring to FIG. 5, an alternative embodiment of the lighting device 100' is now described in greater detail. The lighting device 100' may illustratively include a flow redirection structure 160' which may be configured to redirect fluid flow incident thereupon about at least a portion of the optical chamber 122' and the flow of thermally-conductive fluid which may be generated by the fluid flow generator 140' may be in the direction of the flow redirection structure 160'. The flow redirection structure 160' may be positioned proximate to an apex of the optical chamber 122' and the fluid flow generator 140' may be positioned proximate to a nadir of the optical chamber 122'. The flow redirection structure 160' may also be configured to redirect at least a portion of the fluid flow incident thereupon generally in the direction of the fluid flow generator 140'. Those skilled in the art will appreciate that the flow redirection structure 160' may be positioned along any portion of the optic 120' as desired. The flow redirection structure 160' may be any shape desired, such as a pyramid or a cone and the sides of the flow redirection structure 160' may be straight, curved, slanted, or a combination thereof.

Furthermore, the flow redirection structure 160' may be attached to the optic 120' through the use of an adhesive, glue, latch, screw, bolt, nail, or any other attachment method as may be understood by those skilled in the art after having had the benefit of this disclosure. The flow redirection structure 160' may also be an integral part of the optic 120'. In addition, those skilled in the art will appreciate that any number of flow redirection structures 160' may be used and any number of sizes of the flow redirection structure 160' may be used. The other features of this embodiment of the lighting device 100' are similar to those of the first embodiment of the lighting device 100, are labeled with prime notation, and require no further discussion herein.

Figure 6:
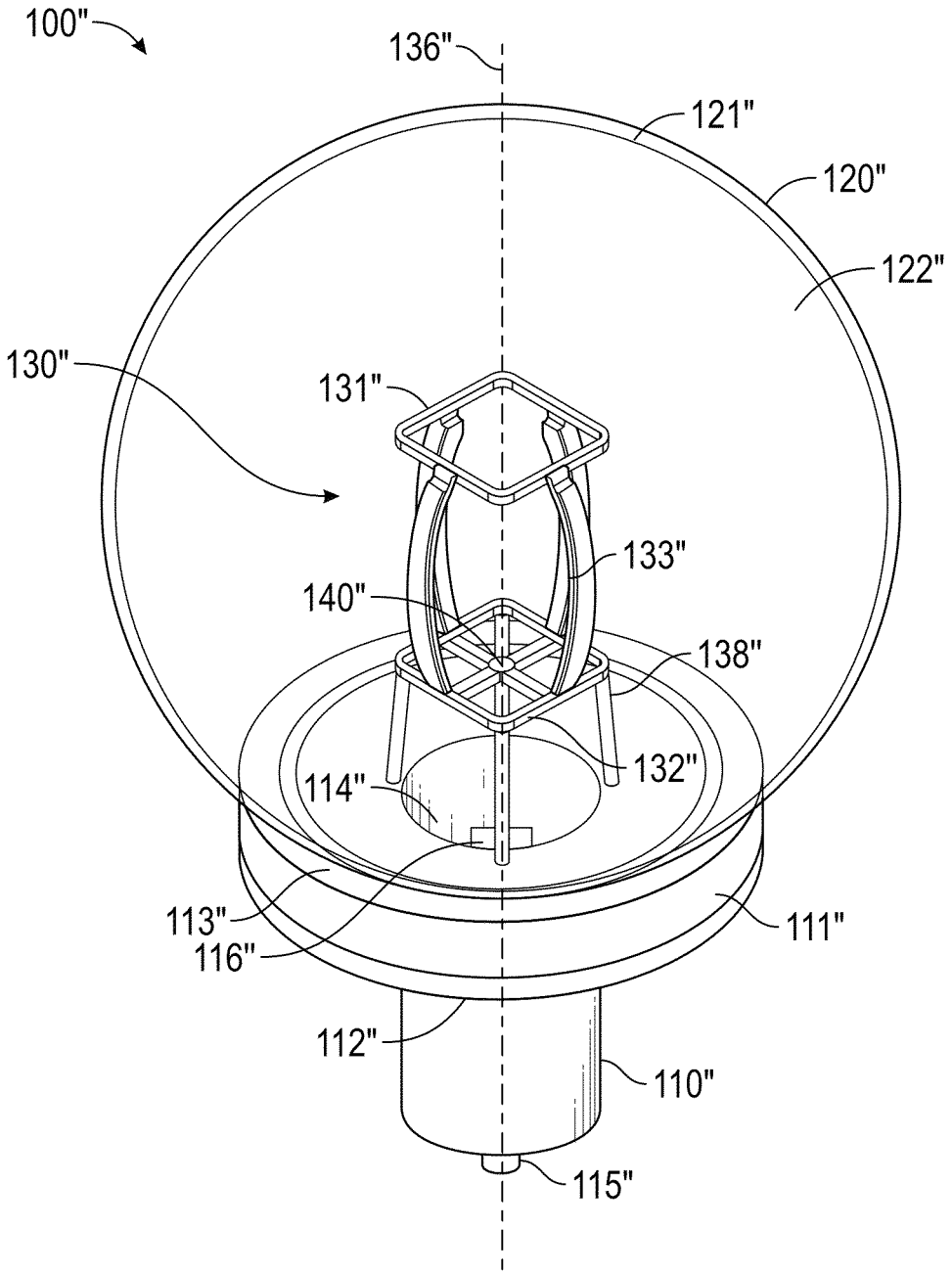
FIG. 6 is a perspective view of a lighting device according to still another embodiment of the present invention.
Figure 7:
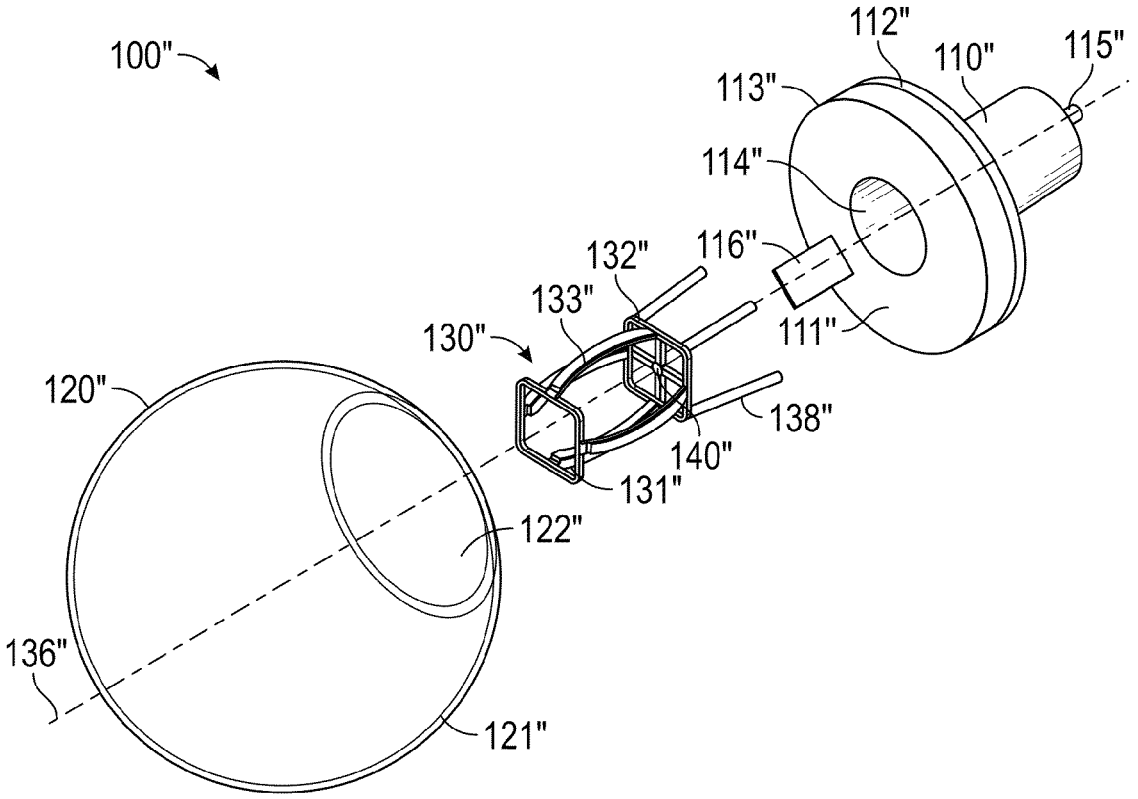
FIG. 7 is an exploded perspective view of the lighting device illustrated in FIG. 6.

Referring now additionally to FIGS. 6-7, yet another embodiment of the lighting device 100" is now described in greater detail. In this embodiment of the lighting device 100", the filament structure 130" may include the LED filaments 133" that have a curvature similar to that of the optic 120". Those skilled in the art will appreciate that the LED filaments 133" may have any curvature while still accomplishing the goals, features and advantages according to the present invention.

The LED filament structure 130 may have a curvature that may be approximately equal to a curvature of the inner surface 121 of the optic 120. The LED filament structure 130 may be configured to generally conform to the curvature of the optic 120 that may conform to a bulb configuration selected from the group consisting of A19, A15, A21, ST19, ST15, S21, S11, C7, G25, G20, PAR30, PAR20, BR30, BR40, and R20. Those skilled in the art will appreciate that the optic 120 may be formed into any shape desired. The remaining elements of this embodiment of the lighting device 100" are similar to those of the first embodiment of the lighting device 100, are labeled with double prime notation, and require no further discussion herein.

Figure 8:
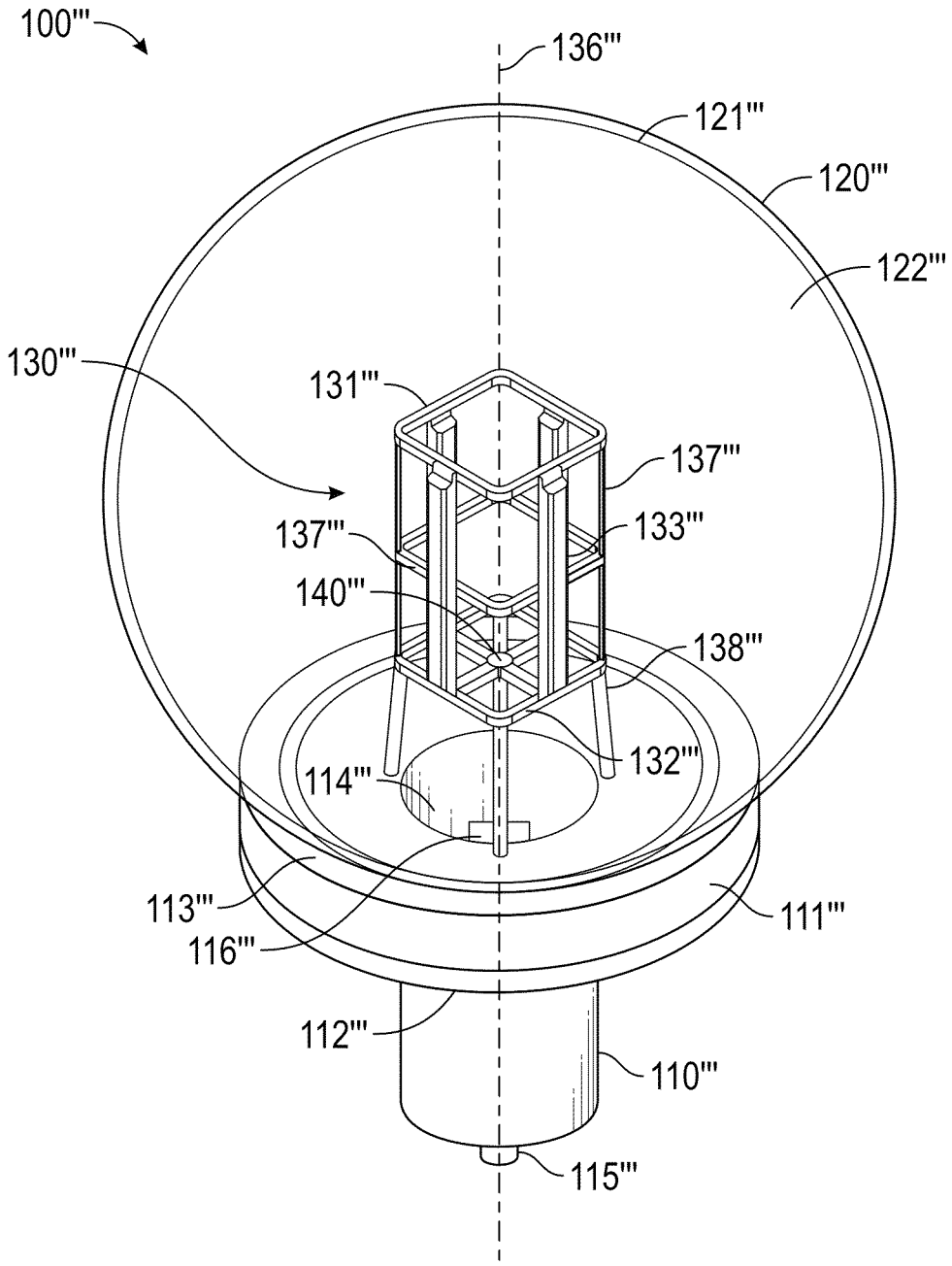
FIG. 8 is a perspective view of a lighting device according to yet another embodiment of the present invention.

Referring now additionally to FIG. 8, yet another embodiment of the lighting device 100''' according to the present invention is now described in greater detail. In this embodiment of the lighting device 100''', the LED filament structure 130''' may further include an intermediate bracket 137'''. The intermediate bracket 137''' may be similar to the upper bracket 131''' and/or the lower bracket 132'''. The intermediate bracket 137''' may also be a vertical structural component which may connect the upper bracket 131''' to 132''' and/or support the LED filaments 133'''In addition, the intermediate bracket 137''' may be a combination of structural components similar to those described herein. For example and without limitation, the intermediate bracket 137''' may be a plurality of vertical structural components with a structural component similar to the upper bracket 131''' or the lower bracket 132''' located near a medial portion of the plurality of vertical structural components.

The plurality of LED filaments 133''' may also be positioned on the intermediate bracket 137''' (or in contact with the intermediate bracket). Those skilled in the art will appreciate that the intermediate bracket 137''' may be square, rectangular, circular, ovular, polygonal, or any combination thereof. Although the fluid flow generator 140''' is illustrated as being carried by the lower bracket 132''', those skilled in the art will appreciate that the fluid flow generator may be carried by the intermediate bracket 137''', or by the upper bracket 131'''. The intermediate bracket 137''' may be positioned between the upper bracket 131''' and the lower bracket 132'''.

Those skilled in the art will appreciate that the lighting device 100''' may include any number of intermediate brackets 137'''. In addition, the intermediate bracket 137''' may be curved and/or flexible to allow light to be emitted in more than a hemispherical direction, such as a spherical or semi-spherical direction. The remaining elements of this embodiment of the lighting device 100''' are similar to those of the first embodiment of the lighting device 100, are labeled with triple prime notation, and require no further discussion herein.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

That which is claimed is:

1. A lighting device comprising:

a base having an electrical contact;

a housing attached to the base at a first end and having an internal cavity;

a driver circuit positioned within the internal cavity and in electrical communication with the electrical contact;

an optic having an inner surface defining an optical chamber, the optic being attached to a second end of the housing;

a thermally-conductive fluid positioned within the optical chamber;

a light-emitting diode (LED) filament structure positioned within the optical chamber and in electrical communication with the driver circuit, the LED filament structure comprising:

an upper bracket defined as a polygonal frame, a lower bracket defined as a polygonal frame, a plurality of LED filaments formed as buttresses connecting the upper and lower frames, and a filament support comprised of a plurality of buttresses extending distally from the housing; and a fluid flow generator positioned in fluid communication with the optical chamber and electrical communication with the driver circuit;

wherein the fluid flow generator is adapted to generate a flow of the thermally-conductive fluid in the direction of the LED filament structure.

2. The lighting device according to claim 1 wherein the LED filament structure comprises a plurality of LED dies; and wherein the flow of thermally conductive fluid generated by the fluid flow generator is directed towards at least one LED die of the LED filament structure.

3. The lighting device according to claim 1 wherein the LED filament structure comprises a plurality of LED dies; wherein the plurality of LED dies are arranged so as to define a light-emitting length of the LED filament structure; and wherein the flow of thermally-conductive fluid generated by the fluid flow generator is directed to be incident upon the entire light-emitting length of the LED filament structure.

4. The lighting device according to claim 1 wherein the LED filament structure defines a longitudinal axis; and wherein the flow of thermally-conductive fluid is in a direction of at least one of generally perpendicular to the longitudinal axis of the LED filament structure and generally parallel to the longitudinal axis of the LED filament structure.

5. The lighting device according to claim 1 wherein the fluid flow generator is positioned generally intermediate the driver circuit and the LED filament structure.

6. The lighting device according to claim 1 further comprising a flow redirection structure configured to redirect fluid flow incident thereupon about the optical chamber; and wherein the flow of thermally-conductive fluid generated by the fluid flow generator is in the direction of the flow redirection structure.

7. The lighting device according to claim 6 wherein the flow redirection structure is configured to redirect fluid flow incident thereupon about at least a portion of the optical chamber.

8. The lighting device according to claim 6 wherein the flow redirection structure is positioned proximate to an apex of the optical chamber; and wherein the fluid flow generator is positioned proximate to a nadir of the optical chamber.

9. The lighting device according to claim 6 wherein the flow redirection structure is configured to redirect at least a portion of the fluid flow incident thereupon generally in the direction of the fluid flow generator.

10. The lighting device according to claim 1 wherein the optical chamber and the internal cavity are in fluid communication with each other; and wherein the thermally-conductive fluid is positioned within both the optical chamber and the internal cavity.

11. The lighting device of claim 1 further comprising a heat sink positioned in thermal communication with at least one of the LED filament structure and the driver circuit; wherein the fluid flow generator is positioned to direct the flow of thermally conductive fluid towards at least one of the heat sink, the driver circuit, and the LED filament structure.

12. The lighting device of claim 1 wherein the fluid flow generator is a microblower device.

13. The lighting device of claim 1 wherein the thermally-conductive fluid is at least one of air, helium, neon, and nitrogen.

14. The lighting device of claim 1 wherein the optical chamber and the Internal cavity combine to define an interior volume; and wherein the interior volume is fluidically sealed.

15. The lighting device of claim 1 wherein the LED filament structure has a curvature that is approximately equal to a curvature of the inner surface of the optic.

16. The lighting device of claim 15 wherein the LED filament structure is configured to generally conform to the curvature of the optic that conforms to a bulb configuration selected from the group consisting of A19, A15, A21, ST19, ST15, S21, S11, C7, G25, G20, PAR30, PAR20, BR30, BR40, and R20.

17. The lighting device of claim 2 wherein the plurality of LED dies and the LED filament structure are configured to emit light away from the lighting device at least one of semi-hemispherically, hemispherically, and spherically.

18. A lighting device comprising:

a base having an electrical contact;

a housing attached to the base at a first end and having an internal cavity;

a driver circuit positioned within the internal cavity and in electrical communication with the electrical contact;

an optic having an inner surface defining an optical chamber, the optic being attached to a second end of the housing;

a thermally-conductive fluid positioned within the optical chamber;

a light-emitting diode (LED) filament structure positioned within the optical chamber and in electrical communication with the driver circuit, comprising a plurality of LED dies, the LED filament structure comprising:

an upper bracket defined as a polygonal frame, a lower bracket defined as a polygonal frame, a plurality of LED filaments formed as buttresses connecting the upper and lower frames, and a filament support comprised of a plurality of buttresses extending distally from the housing; and a fluid flow generator positioned in fluid communication with the optical chamber and electrical communication with the driver circuit;

wherein the fluid flow generator is positioned proximate to a nadir of the optical chamber;

wherein the plurality of LED dies are arranged so as to define a light emitting length of the LED filament structure; and wherein the fluid flow generator is adapted to generate a flow of the thermally-conductive fluid to be incident upon the entire light-emitting length of the LED filament structure.

19. The lighting device according to claim 18 further comprising a flow redirection structure adapted to redirect fluid flow incident thereupon over at least part of the inner surface of the optic; and wherein the flow of thermally-conductive fluid generated by the fluid flow generator is in the direction of the flow redirection structure.

20. A lighting device comprising:

a base having an electrical contact;

a housing attached to the base at a first end and having an internal cavity;

a driver circuit positioned within the internal cavity and in electrical communication with the electrical contact;

an optic having an inner surface defining an optical chamber, the optic being attached to a second end of the housing;

a thermally-conductive fluid positioned within the optical chamber;

a light-emitting diode (LED) filament structure positioned within the optical chamber and in electrical communication with the driver circuit, the LED filament structure comprising:

an upper bracket defined as a circular frame, a lower bracket defined as a circular frame, a plurality of LED filaments formed as buttresses connecting the upper and lower frames, and a filament support comprised of a plurality of buttresses extending distally from the housing; and a fluid flow generator positioned in fluid communication with the optical chamber and electrical communication with the driver circuit;

wherein the fluid flow generator is positioned generally intermediate the driver circuit and the LED filament structure; and wherein the fluid flow generator is adapted to generate a flow of the thermally-conductive fluid in the direction of at least one of the driver circuit and the LED filament structure.

21. The lighting device of claim 20 further comprising a flow redirection structure adapted to redirect fluid flow incident thereupon about at least part of the optical chamber; and wherein the flow of thermally-conductive fluid generated by the fluid flow generator is in the direction of the flow redirection structure.

* * * * *